US006500279B2

(12) United States Patent
Chen

(10) Patent No.: US 6,500,279 B2
(45) **Date of Patent: *Dec. 31, 2002**

(54) MATERIAL HAVING THE CAPACITY OF ABSORBING VIBRATION

(76) Inventor: Archer C. C. Chen, No. 501, 28th Rd. Taichung Industrial Park, Taichung (TW)

( * ) Notice: Subject to any disclaimer, the term of this patent is extended or adjusted under 35 U.S.C. 154(b) by 106 days.

This patent is subject to a terminal disclaimer.

(21) Appl. No.: 09/801,911

(22) Filed: Mar. 9, 2001

(65) Prior Publication Data

US 2002/0173374 A1 Nov. 21, 2002

(51) Int. Cl.[7] ..... C22C 38/18; C22C 38/20; C22C 38/22; C22C 38/24; C22C 38/26; C22C 38/28; C22C 38/30; C22C 38/32; C22C 38/34; C22C 38/36; C22C 38/38; C22C 38/58; C22C 38/40; A63B 53/04; A63B 53/06; A63B 53/08

(52) U.S. Cl. ..... 148/325; 148/327; 473/349; 420/74; 420/108

(58) Field of Search ..... 420/36, 35, 38, 420/42, 43, 63, 69, 68, 87, 108; 148/325, 327, 407; 72/341

(56) References Cited

U.S. PATENT DOCUMENTS 4,314,863 A * 2/1982 McCormick ..... 148/37
5,630,888 A * 5/1997 Yoshida et al. ..... 148/325
5,683,310 A * 11/1997 Chen ..... 473/349
6,334,817 B1 * 1/2002 Ezawa et al. ..... 473/324
6,350,209 B1 * 2/2002 Chen ..... 473/345

OTHER PUBLICATIONS

AIAA 96–4572, Nov. 18–22, 1996 Norfolk, Virgina, Roudakov et al.* http://www.dfrc.nasa.gov/DTRS/1996/PS search report.*

* cited by examiner

*Primary Examiner*—Sebastiano Passaniti
*Assistant Examiner*—Sneh Varma
(74) *Attorney, Agent, or Firm*—Browdy and Neimark, P.L.L.C.

(57) ABSTRACT

A material having capacity of absorbing vibration contains maximum amounts of 0.03% of C by weight, 0.2~0.6% of Si by weight, maximum amounts of 0.15% of Mn by weight, maximum amounts of 0.03% of P by weight, maximum amounts of 0.03% of S by weight, 10.5~13.5% of Cr by weight, 0.8~1.4% of Mo by weight, 0.8~1.4% of Al by weight, 0.8~1.4% of Ni by weight, 0.02~0.1% of Nb by weight, maximum amounts of 0.01% of N by weight, maximum amounts of 0.03% of Cu by weight, and the rest being Fe. The material being made by a metallurgical method involving vacuum melting process and normalizing process, whereby the main crystal structure of the material is Fe.

12 Claims, No Drawings

MATERIAL HAVING THE CAPACITY OF ABSORBING VIBRATION

FIELD OF THE INVENTION

The present invention relates generally to a steel material, and more particularly to a material having the capacity of absorbing vibration.

BACKGROUND OF THE INVENTION

For there are more and more products needs a precision production process to be manufactured. Any tiny vibration of the production instrument when running may cause the production failure. To prevent above problem, a metal having capacity of damping is disposed at the base of the precision production instrument to absorb the vibration. The conventional damping metals are S25C steel, pure magnesium and pure aluminum. However, the damping property of the S25C steel (the constituents and some mechanical properties of the S25C steel are shown in Table 2 and Table 3) is not good enough ($Q^{-1}=0.5\times10^{-2}$). So, S25C steel can not provide a superior capacity of absorbing impact and vibration when the instrument running. Beside that, the S25C steel has a poor capacity of anti-rust. The pure magnesium and pure aluminum provided a good capacity of absorbing impact and vibration, but they has a lower strength property and not easy to weld to the other elements of the instrument.

SUMMARY OF THE INVENTION

The primary objective of the present invention is to provide a material, which has a superior capacity of absorbing impact and vibration.

Another objective of the present invention is to provide a material which has a capacity of anti-rust and easy to weld.

In keeping with the objective of the present invention, the material having the capacity of absorbing vibration contains maximum amounts of 0.03% of C by weight, 0.2~0.6% of Si by weight, maximum amounts of 0.15% of Mn by weight, maximum amounts of 0.03% of P by weight, maximum amounts of 0.03% of S by weight, 10.5~13.5% of Cr by weight, 0.8–1.4% of Mo by weight, 0.8–1.4% of Al by weight, 0.8~1.4% of Ni by weight, 0.02~0.1% of Nb by weight, maximum amounts of 0.01% of N by weight, maximum amounts of 0.03% of Cu by weight, and the rest being Fe. The material being made by a metallurgical method whereby the main crystal structure of said material is ferrite.

DETAILED DESCRIPTION OF THE INVENTION

Before completing the material for the present invention. The inventor of the present invention made seven test alloys (F1~F7) with a variety of constituents and different quantities of the constituents. Measuring the material properties of the testing alloy to find the vary prescription of the material of the present invention.

Please refer to the Table 1, shown the constituents and some mechanical properties of the testing alloy. Each of the testing alloys being vacuum induction melting in a vacuum melting furnace. The temperature of casting set to 950° C.~1050° C. The temperature of rolling set to 950° C.~1050° C. The damping property of the testing alloys are tested by the method of resonance of audio frequency, the voltage is 15 V. Tensile test is proceeded by an universal testing machine, and watching the crystal structures of the testing alloys with a microscope.

Analyzing the Table 1, hereunder are our conclusions:

1. For the crystal structures of the testing alloys, we found the F5 and F6 each has a double crystal structures of ferrite steel+pearlite steel. The damping coefficients ($Q^{-1}$) of the F5 and F6 testing alloy are 2.3 and 3.6, respectively. They are significantly smaller than the other testing alloys(F1~F4 and F7) which has a single crystal structure of ferrite steel. So, we conclude that the alloy with a single crystal structure of ferrite steel has a superior damping property.

2. Adding chromium (Cr) to the alloy can prevent rusting. According to Table 1, when the Cr exceeds 10 wt %, the damping property of the alloy will increase significantly. In comparison with F1 and F3, when the Cr increasing from 12 wt % to 15 wt %, the value of the damping property did not change significantly, but decrease a lot in the percentage of elongation. Comparing with F1 and F6, the second crystal structure—pearlite steel will come out when there is about 10 wt % of Cr in the alloy. So, the optimum quantity of Cr is about 12 wt %.

3. When the testing alloy contained less than 0.005 wt % C, such as F2 and F7, the alloys had superior properties in damping and mechanical performance, But the alloys are difficult in metallurgical process. Thus, setting the quantity of C to ≦0.03 wt % is a good choice.

4. Adding Ni to increase the ductility of the alloy. Comparing F5 and F7, to prevent forming the double crystal structure of ferrite steel+pearlite steel, adding Ni only at a lower quantity of C to form a single crystal structure of ferrite steel of the alloy.

5. In comparison with F3 and F4, Al can increase the damping property of the alloy. But if there is a large quantity of Al, the alloy will form a double crystal structure. The optimum quantity of Al is about 1 wt %.

6. Adding a small quantity of Nb can make the crystal grain of the alloy fineness. The optimum quantity of Nb is about 0.04 wt %.

7. Adding Mo can strengthen the crystal base of the alloy, it also can increase the strength and the anti-rusting of alloy. The optimum quantity of Mo is about 1 wt %.

8. If the alloy had too much Si, it will increase the brittleness of the alloy. Too less of Si, it will decrease the damping capacity of the alloy. The optimum quantity of Si is about 0.35 wt %.

According to the conclusions above, the inventor of the present invention creates a steel alloy with a special prescription, and named it "Fekral" steel.

Please refer to the Table 2, the Fekral steel contains ≦0.001 wt % carbon (C), 0.3821 wt % silicon (Si), 0.0801 wt % manganese (Mn), 0.0119 wt % phosphorous (P), 0.0046 wt % sulfur (S), 12.45 wt % chromium (Cr), 1.219 wt % molybdenum (Mo), 0.942 wt % aluminum (Al), 1.178 wt % nickel (Ni), 0.045 wt % niobium (Nb), ≦0.01 wt % nitrogen (N), and ≦0.03 wt % copper (Cu), the rest mainly being iron (Fe). The Fekral alloy being made by a metallurgical method involving vacuum melting process and normalizing process at 950° C.×1 hr, whereby the main crystal structure of the Fekral alloy is ferrite steel.

Some of the mechanical properties of the Fekral alloy and the S25C steel shown in Table 3. According to the data of Table 3, The damping coefficient of the Fekral steel ($Q^{-1}=9.0\times10^{-2}$) is 18 times larger than the S25C steel ($Q^{-1}=0.5\times10^{-2}$). The Fekral steel also has superior mechanical capacities than the S25C steel in yield strength, tensile strength, ratio of elongation and ratio of contraction.

The main reason of the damping coefficient of the Fekral steel larger than the S25C steel is that the Fekral steel has a single crystal structure of ferrite steel and S25C steel is has a double crystal structure of ferrite steel+pearlite steel. According to the theory of material science, the Fekral steel is softer and the crystal structure is uniform after normalizing. The Fekral steel can absorb the force in vertical direction to the horizontal direction by the crystal boundary. So that, the Fekral steel has a superior damping capacity than the S25C steel.

Next, we put the Fekral steel and the S25C steel into seawater to test the anti-rusting capacity of thereof.

Please refer to Table 4 for the result of the rusting test. The result shows the Fekral steel had a bigger rusting quantity (0.0231 g/hm$^2$) and then decreased as time go on. After the 25$^{th}$ day of testing, the rusting quantity of the Fekral steel kept in 0.0003 g/hm$^2$. But the rusting quantity of the S25C steel, after the 18$^{th}$ day of testing, kept in 0.03 g/hm$^2$. It is the 100 times of the rusting quantity of the Fekral steel. The test proofs the Fekral steel has a superior anti-rusting capacity than the S25C steel.

Hereunder are the advantages of the Fekral steel of the present invention:

1. The S25C steel, the conventional damping material, has a double crystal structure of ferrite+pearlite, so it has a lower damping coefficient ($Q^{-1}$=0.5×10$^{-2}$). The Fekral steel of the present invention has a single crystal structure of ferrite, so it has a higher damping coefficient ($Q^{-1}$9.0×10$^{-2}$), which is 18 times larger than the damping coefficient of S25C steel. Thus, the material of the present invention provides a superior capacity of absorbing impact and vibration.

2. The Fekral steel material of the present invention has a superior capacity of anti-rusting than S25C steel. So the material of the present invention does not need to be plated with an anti-rusting coating on its surface as does the conventional S25C damping material. The Fekral steel of the present invention thus requires less procedure to manufacture than the conventional damping material, thereby reducing the production cost.

3. The Fekral steel of the present invention is a stainless steel. It is easy to be welding (or brazing) to the other elements than pure magnesium and pure aluminum. The Fekral steel also provides a larger strength of welding (or brazing) structure.

It is to be understood that are not intended for use as a definition of the limits and scope of the invention disclosed.

TABLE 1

| | C | Si | Cr | Ni | Mo | Al | Nb | N | C + N | P | S | Damping coefficient ($Q^{-1}$ × $10^{-2}$) | Yield strength (Mpa) | Tensile strength (Mpa) | Elongation (%) | Contraction (%) | Crystal structure |
|---|---|---|---|---|---|---|---|---|---|---|---|---|---|---|---|---|---|
| F1 | 0.039 | 0.26 | 12.05 | — | 1.16 | 0.96 | 0.048 | 0.0036 | 0.042 | <0.02 | <0.02 | 5.5 | 284.7 | 450.8 | 30.5 | 51.6 | Ferrite |
| F2 | 0.004 | 0.29 | 11.99 | — | 1.15 | 0.96 | 0.042 | 0.0042 | 0.0082 | <0.02 | <0.02 | 6.4 | 270.4 | 442.2 | 48.0 | 78.6 | Ferrite |
| F3 | 0.032 | 0.28 | 15.16 | — | 1.15 | 0.97 | 0.042 | 0.0032 | 0.0352 | <0.02 | <0.02 | 5.9 | 320.9 | 462.1 | 24.4 | 47.4 | Ferrite |
| F4 | 0.036 | 0.32 | 15.36 | — | 1.13 | — | 0.043 | 0.0032 | 0.0392 | <0.02 | <0.02 | 5.4 | 285.1 | 466.3 | 31.8 | 65.2 | Ferrite |
| F5 | 0.051 | 0.28 | 10.27 | 1.15 | 1.10 | 0.98 | 0.042 | 0.0038 | 0.0548 | <0.02 | <0.02 | 2.3 | 335.2 | 489.1 | 31.3 | 59.3 | Ferrite + Pearlite |
| F6 | 0.032 | 0.26 | 10.36 | — | 1.07 | 0.95 | 0.041 | 0.0032 | 0.0352 | <0.02 | <0.02 | 3.6 | 246.1 | 4118.8 | 39.0 | 76.4 | Ferrite + Pearlite |
| F7 | 0.005 | 0.26 | 10.21 | 1.18 | 1.08 | 0.95 | 0.041 | 0.0035 | 0.0085 | <0.02 | <0.02 | 7.6 | 282.4 | 437.2 | 39.6 | 76.2 | Ferrite |

unit : wt %
the rest is Fe

TABLE 2

| | C | Si | Mn | P | S | Cr | Mo | Al | Ni | Nb | N | Cu | Fe |
|---|---|---|---|---|---|---|---|---|---|---|---|---|---|
| Fecral | <0.001 | 0.3821 | 0.0801 | 0.0119 | 0.0046 | 12.45 | 1.219 | 0.942 | 1.178 | 0.045 | 0.008 | 0.212 | Bal |
| S25C | 0.22~0.28 | 0.1 max | 0.3~0.4 | 0.04 max | 0.05 max | — | — | — | — | — | — | — | Bal |

unit : wt %

TABLE 3

| | Damping coefficient ($Q^{-1}$ × $10^{-2}$ | Yield strength (Mpa) | Tensile strength (Mpa) | Elongation (%) | Contraction (%) | Crystal structure |
|---|---|---|---|---|---|---|
| Fecral | 9.0 | 343 | 550 | 38 | 72 | Ferrite |
| S25C | 0.5 | 294 | 490 | 27 | 47 | Ferrite + Pearlite |

TABLE 4

| | Day | | | | | | |
|---|---|---|---|---|---|---|---|
| | 2 | 4 | 8 | 12 | 18 | 25 | 32 |
| Fecral | 0.0231 | 0.0024 | 0.0012 | 0.0006 | 0.0005 | 0.0003 | 0.0003 |
| S25C | −0.0047 | −0.020 | −0.023 | −0.026 | −0.030 | −0.030 | −0.030 |

unit : g/h m$^2$

What is claimed is:

1. A material, the constituents of said material comprises maximum amounts of 0.03% of C by weight, 0.2~0.6% of Si by weight, maximum amounts of 0.15% of Mn by weight, maximum amounts of 0.03% of P by weight, maximum amounts of 0.03% of S by weight, 10.5~13.5% of Cr by weight, 0.8–1.4% of Mo by weight, 0.8–1.4% of Al by weight, 0.8~1.4% of Ni by weight, 0.02~0.1% of Nb by weight, maximum amounts of 0.01% of N by weight, maximum amounts of 0.03% of Cu by weight, and the rest being Fe;

said material being made by a metallurgical method involving a vacuum melting process, and normalizing process at a predetermined temperature and a predetermined time, whereby the main crystal structure of said material is ferrite.

2. The material as defined in claim 1, wherein said material contains about 0.01% C by weight.

3. The material as defined in claim 1, wherein said material contains about 0.35% Si by weight.

4. The material as defined in claim 1, wherein said material contains less than 0.01% P by weight.

5. The material as defined in claim 1, wherein said material contains less than 0.01% S by weight.

6. The material as defined in claim 1, wherein said material contains about 12% Cr by weight.

7. The material as defined in claim 1, wherein said material contains about 1% Mo by weight.

8. The material as defined in claim 1, wherein said material contains about 1% Al by weight.

9. The material as defined in claim 1, wherein said material contains about 1% Ni by weight.

10. The material as defined in claim 1, wherein said material contains about 0.04% Nb by weight.

11. The material as defined in claim 1, having a structure achieved providing the temperature of the normalizing process between 950° C.~1000° C.

12. The material as defined in claim 1, having a structure achieved by providing the time of the normalizing process between 0.8 hr~1.2 hr.

* * * * *